US008251762B2

(12) United States Patent
Maier et al.

(10) Patent No.: US 8,251,762 B2
(45) Date of Patent: Aug. 28, 2012

(54) HF-ANGLE PLUG CONNECTOR

(75) Inventors: Guenther Maier, Fridolfing (DE); Helmut Muehlfellner, Kirchanschoering (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 13/126,595

(22) PCT Filed: Oct. 26, 2009

(86) PCT No.: PCT/EP2009/007650

§ 371 (c)(1), (2), (4) Date: Jun. 7, 2011

(87) PCT Pub. No.: WO2010/049109

PCT Pub. Date: May 6, 2010

(65) Prior Publication Data

US 2011/0230092 A1 Sep. 22, 2011

(30) Foreign Application Priority Data

Oct. 29, 2008 (DE) ..... 20 2008 014 409 U

(51) Int. Cl.
*H01R 13/46* (2006.01)

(52) U.S. Cl. ..... 439/892; 439/521; 439/582

(58) Field of Classification Search ..... 439/521, 439/582, 892

See application file for complete search history.

(56) References Cited

U.S. PATENT DOCUMENTS

| | | | | |
|---|---|---|---|---|
| 3,480,722 | A * | 11/1969 | Van Horssen et al. | 174/87 |
| 4,096,627 | A * | 6/1978 | Forney et al. | 29/620 |
| 4,655,534 | A | 4/1987 | Stursa | |
| 4,799,900 | A * | 1/1989 | Capp et al. | 439/585 |
| 5,498,169 | A * | 3/1996 | Ikemoto | 439/260 |
| 7,946,886 | B1 * | 5/2011 | Liu | 439/582 |
| 2003/0176104 | A1 | 9/2003 | Hall et al. | |
| 2011/0230092 | A1 * | 9/2011 | Maier et al. | 439/578 |
| 2011/0237104 | A1 * | 9/2011 | Biesse et al. | 439/271 |

FOREIGN PATENT DOCUMENTS

| | | | |
|---|---|---|---|
| DE | 19932942 | A1 | 3/2001 |
| DE | 69427891 | T2 | 4/2002 |
| WO | 2007098617 | A1 | 9/2007 |

* cited by examiner

*Primary Examiner* — James Harvey
(74) *Attorney, Agent, or Firm* — DeLio & Peterson, LLC; Robert Curcio

(57) ABSTRACT

An HF angle plug connector having an exterior conductor component and an interior conductor component, wherein the interior conductor component has a fastening element for mechanical and electrical connection to an interior conductor component of a coaxial cable, wherein the exterior conductor component has a cable-side end on which the coaxial cable is arranged and a front face opposite the cable-side end, the front face being transected by a longitudinal axis of the installed coaxial cable, and wherein an inspection opening is on the exterior conductor component such that the fastening element of the interior conductor component is visible through the inspection opening after installation of the interior conductor component of the coaxial cable on the fastening element of the interior conductor component, wherein a cover component for closing the inspection opening is one piece with the exterior conductor component.

24 Claims, 3 Drawing Sheets

HF-ANGLE PLUG CONNECTOR

This application is a National Stage filing based on PCT/EP2009/007650, filed Oct. 26, 2009, and which claims priority to German Patent Application No. DE 20 2008 014 409.4, filed Oct. 29, 2008.

BACKGROUND OF THE INVENTION

1. Field of the Invention

The present invention relates to a high frequency (HF) angle plug connector with an exterior conductor component and an interior conductor component, wherein the interior conductor component possesses a fastening element for mechanical and electrical connection to an interior conductor of a coaxial cable, wherein the exterior conductor component comprises a cable-side end on which the coaxial cable is arranged and a front face opposite the cable-side end, the front face being transected by a longitudinal axis of the installed coaxial cable, and wherein an inspection opening is arranged and designed on the exterior conductor component in such a way that the fastening element of the interior conductor component is visible through the inspection opening after installation of the interior conductor component of the coaxial cable on the fastening element of the interior conductor component, wherein a cover component for closing the inspection opening is formed in one piece with the exterior conductor component.

2. Description of Related Art

DE 199 32 942 A1 describes an HF angle plug connector with a coding housing for a plug which is to be accommodated, as well as a socket housing in which connecting means for a coaxial cable are arranged. The coding housing can be connected with the socket housing in different positions, so that the coaxial cable can be led off in different directions.

US 2003/0176104 A1 discloses a coaxial plug connector with a plastic housing which conforms to the so-called FAKRA (Fachkreis Automobiltechnik) standardization scheme for SMB connections. This features a plastic housing which holds and protects the plug connector and pre-positions it for plugging together with another plug connector with plastic housing. The housing possesses additional mechanical codings so that only matching housings can be plugged together.

Such plastic housings for coaxial plug connectors, also referred to as FAKRA housings, are used in the automotive industry for data transmission cables. These data transmission cables are usually coaxial cables or similar cables based on an electrical conductor. The mechanical dimensions of such FAKRA housings in the interface region, i.e., in an axial section of the housing which interacts with a complementary plug in order to create a mechanical connection between the two plastic housings, are specified in the DIN standard 72594-1 in the version of October 2004. The section "Road Vehicles—50-ohm High-Frequency Interface (50-Ω-HF-SSt)—Part 1: Dimensions and Electrical Requirements" of the aforementioned DIN standard 72594-1 defines the plug and coupler of an interface with an impedance of 50 ohm for high-frequency applications (50-Ω-HFSSt) in road vehicles, ensuring communication to and from the motor vehicle. It defines dimensional and electrical requirements and properties and ensures their exchangeability. All major car manufacturers manufacture according to this standard. The content of this standard is defined by the standardization committee for motor vehicles (FAKRA).

The standardization committee for motor vehicles (FAKRA) in the DIN represents the regional, national and international standardization interests in the field of automotive engineering. The scope of FAKRA's functions includes the drafting of all standards relating to compatibility, exchangeability and safety for road vehicles according to DIN 70010 (with the exception of agricultural tractors), irrespective of whether these road vehicles are equipped with internal combustion engines, electric motors or hybrid drives. FAKRA also drafts standards for the attachments to these road vehicles (with the exception of municipal and fire service vehicles and ambulances). It is also responsible for the standardization of all the equipment of the aforementioned vehicles and attachments as well as for the standardization of freight containers (ISO container). Standardization promotes rationalization and quality in the manufacture of motor vehicles as well as the environmental compatibility of the motor vehicle. In reflecting the current state of technology and science, it also makes a contribution to increasing vehicle and traffic safety, to the benefit of manufacturers and consumers.

DE 694 27 891 T2 discloses a coaxial plug with an opening on a rear side of an external plug contact, wherein a cover is provided which seals the opening in the external plug contact after a coaxial cable has been attached to the coaxial plug. This cover is formed on the external plug contact in the form of a cover section and is bent over.

SUMMARY OF THE INVENTION

Bearing in mind the problems and deficiencies of the prior art, it is therefore an object to provide an invention which is directed to an HF angle plug connector including an exterior conductor component and an interior conductor component, wherein the interior conductor component comprises a fastening element for mechanical and electrical connection to an interior conductor component of a coaxial cable, wherein the exterior conductor component comprises a cable-side end on which the coaxial cable is arranged and a front face opposite the cable-side end, the front face being transected by a longitudinal axis of the installed coaxial cable, and including an inspection opening on the exterior conductor component such that the fastening element of the interior conductor component is visible through the inspection opening after installation of the interior conductor component of the coaxial cable on the fastening element of the interior conductor component, wherein a cover component for closing the inspection opening is designed in one piece with the exterior conductor component, such that the inspection opening is on the front face of the exterior conductor component.

The HF angle plug connector may include a coding housing arranged on the exterior conductor component in such a way that the coding housing is rotatable relative to the exterior conductor component. The coding housing may include mechanical dimensions in its interface region which conform to the DIN standard 72594-1:2004-10, "Road Vehicles—50-ohm High-Frequency Interface (50-Ω-HFSSt)—Part 1: Dimensions and Electrical Requirements", section "3. Dimensions and coding", FIGS. 1 to 3.

The coding housing may further include in its interface region a mechanical coding with mechanical dimensions which conform to the DIN standard 72594-1:2004-10, "Road Vehicles—50-ohm High-Frequency Interface (50-Ω-HF-SSt)—Part 1: Dimensions and Electrical Requirements", section "3. Dimensions and coding", FIGS. 4 and 5.

The coding housing may include an elastically deformable snap-in tongue which is arranged and designed in such a way that the snap-in tongue fixes predetermined angular positions of the coding housing relative to the exterior conductor component and unlocks when a complementary plug is plugged into the coding housing, so that, in its plugged state, the coding housing is freely rotatable in relation to the exterior conductor component.

The coding housing may also comprise a locking element for mechanical locking with a coding housing of a complementary plug connector. An extension element may be arranged on the locking element displaceable along the locking element. The locking element may be designed as a rocker.

The cover component comprises at least one flap which is connected in a single piece with the exterior conductor component on the edge of the inspection opening. The cover component and the exterior conductor component may comprise identical materials, and may be formed in a single piece as a stamped and bent part.

The front face of the exterior conductor component may be arranged at right angles to the longitudinal axis of the installed coaxial cable.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 3:
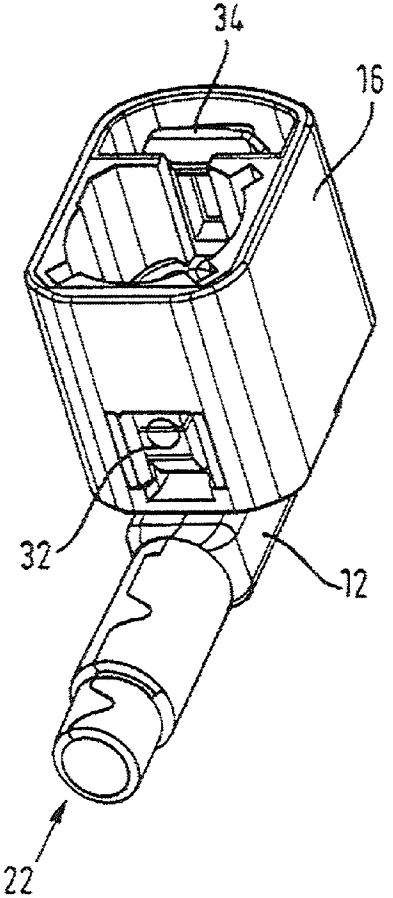
FIG. 3 shows a further perspective view of a preferred embodiment of an HF angle plug connector in accordance with the invention as shown in FIG. 1.
Figure 2:
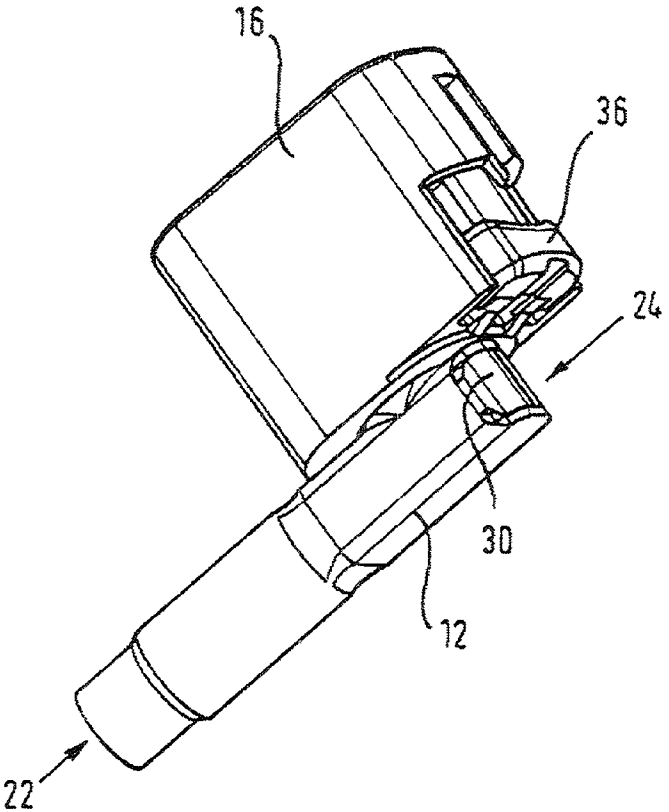
FIG. 2 shows a further perspective view of a preferred embodiment of an HF angle plug connector in accordance with the invention as shown in FIG. 1.
Figure 1:
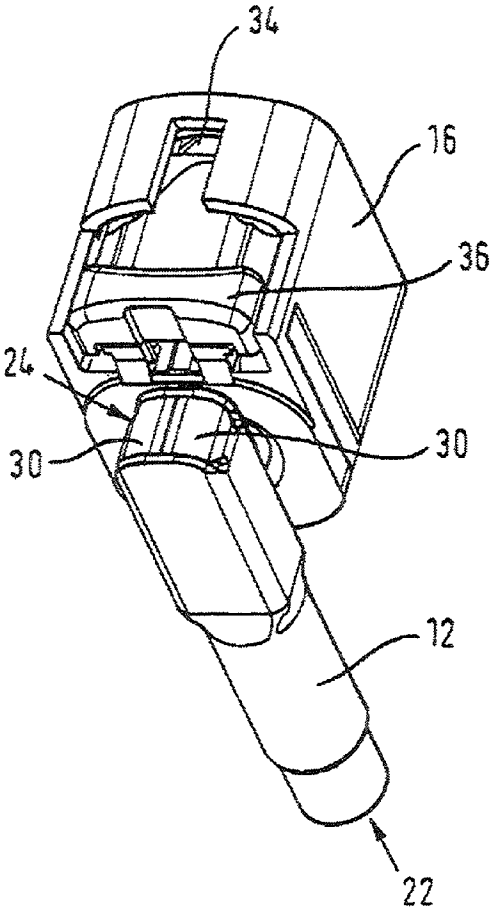
FIG. 1 shows a perspective view of a preferred embodiment of an HF angle plug connector in accordance with the invention.
Figure 4:
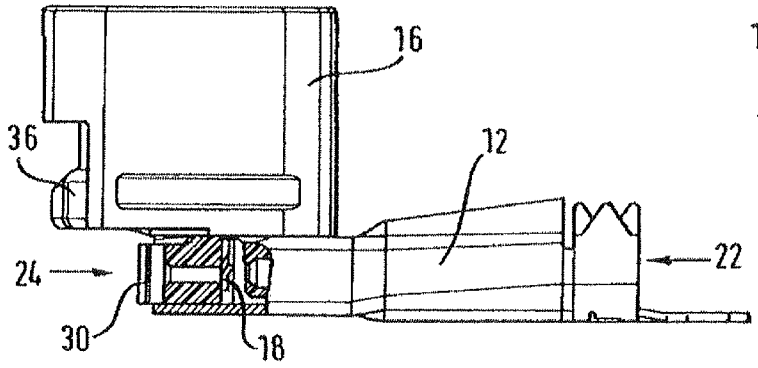
FIG. 4 shows the preferred embodiment of an HF angle plug connector in accordance with the invention as shown in FIG. 1 in a partially cut-away side view with open inspection opening, without installed coaxial cable.
Figure 5:
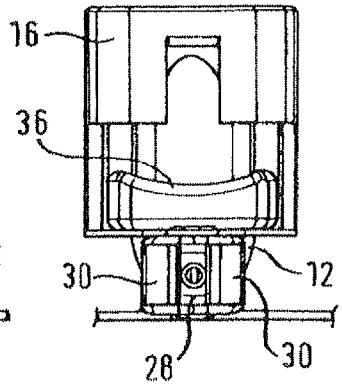
FIG. 5 shows a top view of a preferred embodiment of an HF angle plug connector in accordance with the invention as shown in FIG. 1 with open inspection opening, without installed coaxial cable.
Figure 6:
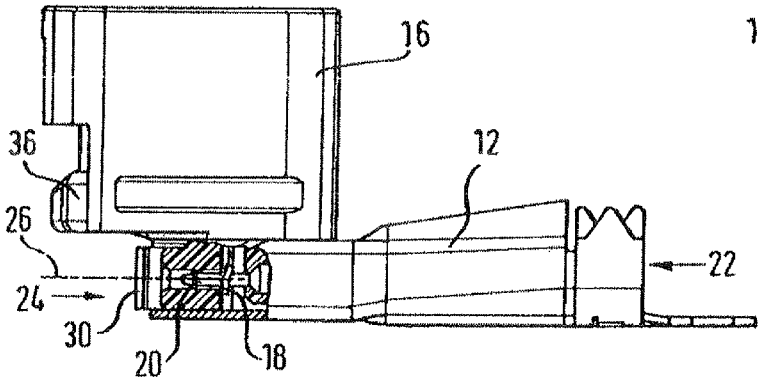
FIG. 6 shows the preferred embodiment of an HF angle plug connector in accordance with the invention as shown in FIG. 1 in a partially cut-away side view with open inspection opening and installed inner conductor part of a coaxial cable.
Figure 7:
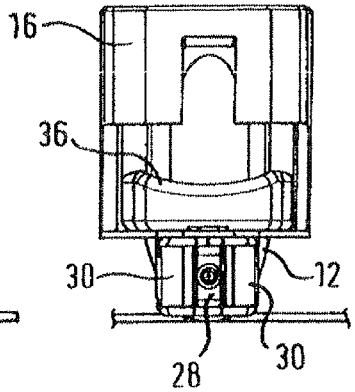
FIG. 7 shows a top view of a preferred embodiment of an HF angle plug connector in accordance with the invention as shown in FIG. 1 with open inspection opening and installed inner conductor component of a coaxial cable.

In describing the preferred embodiment of the present invention, reference will be made herein to FIGS. 1-10 of the drawings in which like numerals refer to like features of the invention.

The invention is based on the problem of improving an HF angle plug connector of the aforementioned type with respect to installation and electrical properties.

This problem is solved according to the invention through an HF angle plug connector of the aforementioned type with the features identified herein. Advantageous embodiments of the invention are described in the claims.

In an HF angle plug connector of the aforementioned type, according to the invention the inspection opening is formed on the front face of the exterior conductor component.

This has the advantage that a particularly good electrical shielding effectiveness, of particularly high quality, is also achieved in the region of the inspection opening.

The inspection opening can be sealed simply after a coaxial cable is connected to the HF-plug connector, for example by bending the cover component.

In a preferred embodiment, a coding housing is arranged on the exterior conductor component in such a way that the coding housing can be rotated relative to the exterior conductor component. A mechanical coding for a complementary HF-plug connector is formed on the coding housing.

The coding housing preferably has mechanical dimensions in its interface region which conform to the DIN standard 72594-1:2004-10, "Road Vehicles—50-ohm High-Frequency Interface (50-Ω-HFSSt)—Part 1: Dimensions and Electrical Requirements", section "3. Dimensions and coding", FIGS. 1 to 3.

The coding housing preferably possesses in its interface region a mechanical coding with mechanical dimensions which conform to the DIN standard 72594-1:2004-10, "Road Vehicles—50-ohm High-Frequency Interface (50-Ω-HF-SSt)—Part 1: Dimensions and Electrical Requirements", section "3. Dimensions and coding", FIGS. 4 and 5.

A defined and fixed pre-positioning of the coding housing, wherein fixing is enabled after a complementary plug connector is plugged in, is achieved in that the coding housing possesses an elastically deformable snap-in tongue which is arranged and designed in such a way that the snap-in tongue fixes predetermined angular positions of the coding housing relative to the exterior conductor component and unlocks when a complementary plug is plugged into the coding housing, so that, in its plugged state, the coding housing is freely rotatable in relation to the exterior conductor component.

In order to allow mechanically solid connection of a plugged-in complementary plug connector, the coding housing possesses a locking element for mechanical locking with a coding housing of a complementary plug connector. Optionally, an extension element is arranged on the locking element which can be displaced along the locking element. The locking element is, for example, designed as a rocker.

In a preferred embodiment, the cover component comprises at least one flap which is integrally connected with the exterior conductor component on one edge of the inspection opening.

In a particularly preferred embodiment, the cover component comprises two flaps which are arranged on opposite edges of the inspection opening and which are integrally connected with the exterior conductor component, wherein each flap is half the size of the inspection opening.

It is practical for the cover component and the exterior conductor component to be manufactured from identical materials.

An HF angle plug connector with good electrical properties, especially in terms of shielding efficiency, which is particularly economical to manufacture and install, is achieved in that the exterior conductor component and the cover component are formed in a single piece as a punched and bent part.

It is practical for the inspection opening to be rectangular in form.

In a preferred embodiment, the front face of the exterior conductor component is arranged at right angles to the longitudinal axis of the installed coaxial cable.

The preferred embodiment of an HF angle plug connector in accordance with the invention shown in FIGS. 1 to 10 comprises an exterior conductor component 12, an interior conductor component 14 and a coding housing 16 arranged rotatably on the exterior conductor component 12. The interior conductor component 14 comprises a fastening element 18 (FIG. 10) for mechanical and electrical connection with an interior conductor component 20 of a coaxial cable (not shown).

The exterior conductor component 12 possesses a coaxial-cable-side end 22, which is designed to allow a coaxial cable to be plugged into in the HF angle plug connector. A front face 24 is formed on the end of the HF angle plug connector opposite the coaxial-cable-side end 22. The front face 24 is arranged in such a way that a longitudinal axis 26 (FIG. 6) of the coaxial cable transects this front face 24.

According to the invention, an inspection opening 28 is formed on the front face 24, through which the interior conductor component 14 or the fastening element 18 is visible following complete installation of the coaxial cable in the HF angle plug connector. This makes it possible, following installation of the coaxial cable in the HF angle plug connector, to check visually whether the interior conductor component 20 of the coaxial cable is positioned in the correct location within the HF angle plug connector and a corresponding electrical and mechanical contact has been established between the interior conductor component 20 of the coaxial cable and the fastening element 18 of the interior conductor component 14 of the HF angle plug connector during installation.

Figure 8:
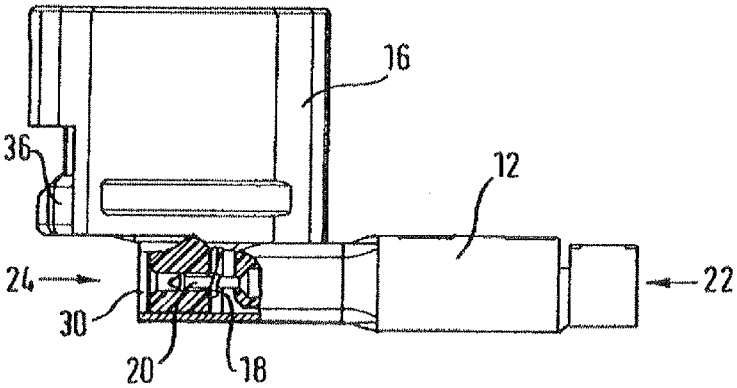
FIG. 8 shows the preferred embodiment of an HF angle plug connector in accordance with the invention as shown in FIG. 1 in a partially cut-away side view with closed inspection opening and installed inner conductor part of a coaxial cable.
Figure 9:
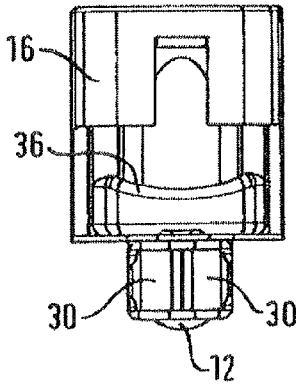
FIG. 9 shows a top view of a preferred embodiment of an HF angle plug connector in accordance with the invention as shown in FIG. 1 with closed inspection opening and installed inner conductor component of a coaxial cable.
Figure 10:
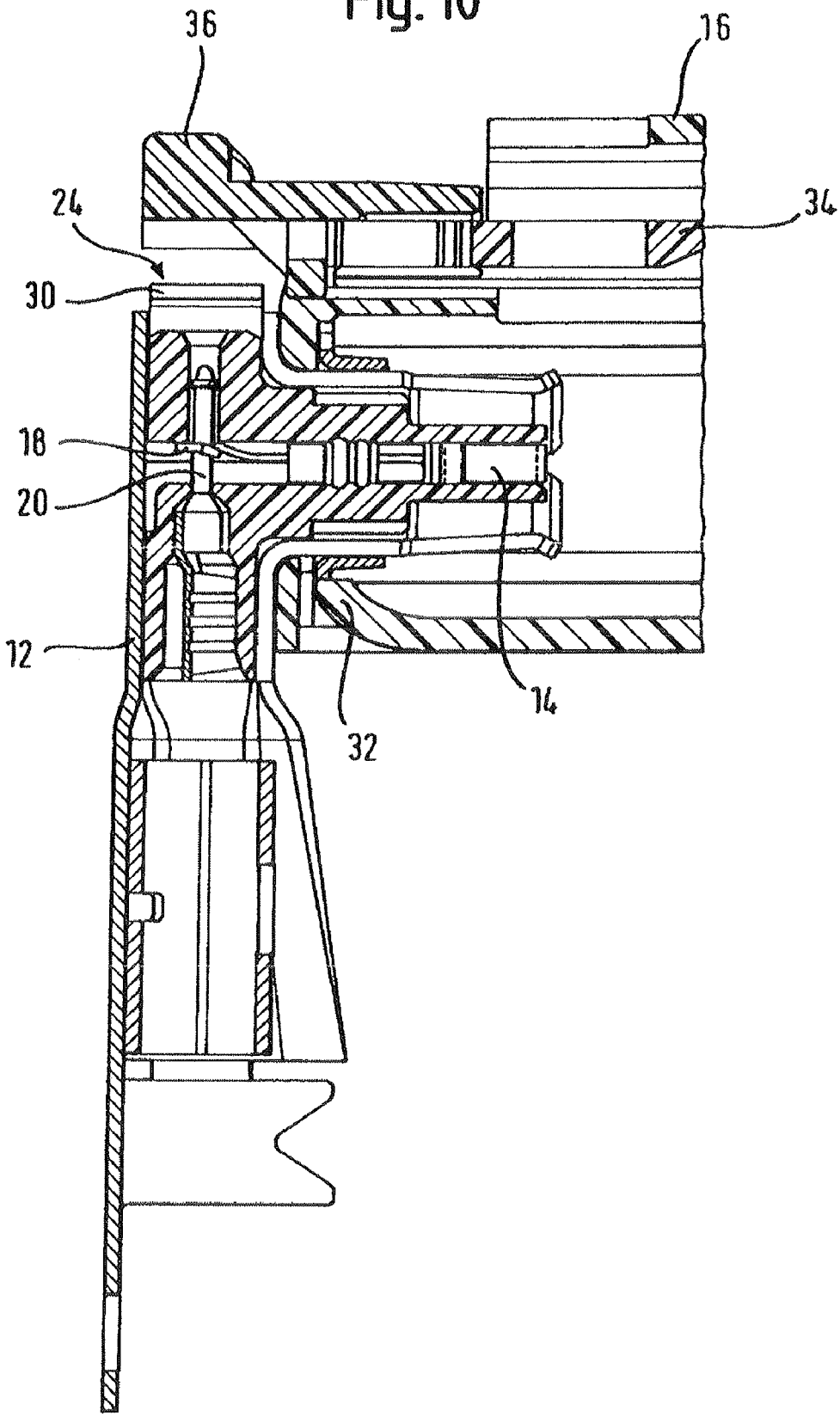
FIG. 10 shows a sectional view of a preferred embodiment of an HF angle plug connector in accordance with the invention as shown in FIG. 1.

Two bendable flaps 30 are also formed on the front face 24 of the exterior conductor component 12 adjacent to the inspection opening 28. These flaps 30 are formed in a single piece with the exterior conductor component 12, with the exterior conductor component 12 and flaps 30 preferably being manufactured as a single punched and bent part. Each flap 30 is around half the size of the inspection opening 28. Following installation of the coaxial cable in the HF angle plug connector and following inspection to confirm correct contacting in the region of the interior conductor component 14, the inspection opening 28 can be closed simply by bending the flaps 30, as shown in FIGS. 8 and 9.

The coding housing 16 displays a mechanical coding, in a known manner, and is designed in conformity with the FAKRA standard. The mechanical coding is intended to ensure that the HF angle plug connector can only be plugged together with a quite specific complementary HF-plug connector with a corresponding coding housing with complementary coding. In order to pre-position the coding housing 16 before plugging it together with a complementary HF-plug connector, this is arranged rotatably relative to the exterior conductor component 12. In order to fix a particular, desired pre-positioned position of the coding housing 16, an elastically deformable snap-in tongue 32 is provided on the coding housing 16. This snap-in tongue 32 opposes the rotary movement of the coding housing 16 with a resistance which fixes a particular pre-positioned position. The snap-in tongue 32 is arranged and designed in such a way that when a complementary HF-plug connector is plugged into the HF angle plug connector the snap-in tongue 32 unlocks, so that the coding housing 16 is freely rotatable after the complementary HF-plug connector is plugged in. In this way, the coding housing can follow any movement of the complementary HF-plug connector, for example due to a plugging action at the other end of the coaxial cable connected with the complementary HF-plug connector or due to a movement of the coaxial cable connected with the complementary HF-plug connector resulting from operation.

The coding housing also possesses a locking element 34 for mechanical locking with a coding housing of a complementary plug connector. This locking element 34 is in the form of a rocker and a rocker extension 36 is arranged on this locking element 34 which, in the extended position shown in FIG. 10, can be displaced along the rocker 34. This creates a greater lever requiring correspondingly less force to unlock the rocker 34 in order to pull a plugged-in complementary HF-plug connector out of the HF angle plug connector again. This rocker extension 36 is pushed in to its maximum extent in FIGS. 1 to 9.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An HF angle plug connector including an exterior conductor component and an interior conductor component, wherein the interior conductor component comprises a fastening element for mechanical and electrical connection to an interior conductor component of a coaxial cable, wherein the exterior conductor component comprises a cable-side end on which the coaxial cable is arranged and a front face opposite the cable-side end, said front face being transected by a longitudinal axis of the installed coaxial cable, and including an inspection opening on the exterior conductor component such that the fastening element of the interior conductor component is visible through the inspection opening after installation of the interior conductor component of the coaxial cable on the fastening element of the interior conductor component, wherein a cover component for closing the inspection opening is designed in one piece with the exterior conductor component, such that the inspection opening is on the front face of the exterior conductor component.

2. The HF angle plug connector of claim 1, including a coding housing arranged on the exterior conductor component in such a way that the coding housing rotatable relative to the exterior conductor component.

3. The HF angle plug connector of claim 2, including a mechanical coding for a complementary HF-plug connector formed on the coding housing.

4. The HF angle plug connector of claim 2, wherein the coding housing can have mechanical dimensions in its interface region which are intended to allow the coding housing to conform to the DIN standard 72594-1:2004-10, "Road Vehicles—50-ohm High-Frequency Interface (50-.OMEGA.-HFSSt)—Part 1.

5. The HF angle plug connector of claim 4, wherein the coding housing includes in its interface region a mechanical coding with mechanical dimensions which are intended to allow the coding housing to conform to the DIN standard 72594-1:2004-10, "Road Vehicles—50-ohm High-Frequency Interface (50-.MEGA.-HFSSt)—Part 1.

6. The HF angle plug connector of claim 2, wherein the coding housing includes an elastically deformable snap-in tongue which is arranged and designed in such a way that the snap-in tongue fixes predetermined angular positions of the coding housing relative to the exterior conductor component and unlocks when a complementary plug is plugged into the coding housing, so that, in its plugged state, the coding housing is freely rotatable in relation to the exterior conductor component.

7. The HF angle plug connector of claim 2, wherein the coding housing includes a locking element for mechanical locking with a coding housing of a complementary plug connector.

8. The HF angle plug connector of claim 7, including an extension element arranged on the locking element displaceable along the locking element.

9. The HF angle plug connector of claim 7, wherein the locking element is designed as a rocker.

10. The HF angle plug connector of claim 1, wherein the cover component comprises at least one flap which is connected in a single piece with the exterior conductor component on the edge of the inspection opening.

11. The HF angle plug connector of claim 1, wherein the cover component comprises two flaps arranged on opposite edges of the inspection opening and which are integrally connected with the exterior conductor component, wherein each flap is approximately half the size of the inspection opening.

12. The HF angle plug connector of claim 1, wherein the cover component and the exterior conductor component comprise identical materials.

13. The HF angle plug connector of claim 1, wherein the exterior conductor component and the cover component are formed in a single piece as a stamped and bent part.

14. The HF angle plug connector of claim 1, wherein the inspection opening is rectangular in form.

15. The HF angle plug connector of claim 1, wherein the front face of the exterior conductor component is arranged at right angles to the longitudinal axis of the installed coaxial cable.

16. The HF angle plug connector of claim 3, wherein the coding housing can have mechanical dimensions in its interface region which are intended to allow the coding housing to conform to the DIN standard 72594-1:2004-10, "Road Vehicles—50-ohm High-Frequency Interface (50-.OMEGA.-HFSSt)—Part 1.

17. The HF angle plug connector of claim 3, wherein the coding housing includes in its interface region a mechanical coding with mechanical dimensions which are intended to allow the coding housing to conform to the DIN standard 72594-1:2004-10, "Road Vehicles—50-ohm High-Frequency Interface (50-.MEGA.-HFSSt)—Part 1.

18. The HF angle plug connector of claim 3, wherein the coding housing includes an elastically deformable snap-in tongue which is arranged and designed in such a way that the snap-in tongue fixes predetermined angular positions of the coding housing relative to the exterior conductor component and unlocks when a complementary plug is plugged into the coding housing, so that, in its plugged state, the coding housing is freely rotatable in relation to the exterior conductor component.

19. The HF angle plug connector of claim 5, wherein the coding housing includes an elastically deformable snap-in tongue which is arranged and designed in such a way that the snap-in tongue fixes predetermined angular positions of the coding housing relative to the exterior conductor component and unlocks when a complementary plug is plugged into the coding housing, so that, in its plugged state, the coding housing is freely rotatable in relation to the exterior conductor component.

20. The HF angle plug connector of claim 5, wherein the coding housing includes a locking element for mechanical locking with a coding housing of a complementary plug connector.

21. The HF angle plug connector of claim 6, wherein the coding housing includes a locking element for mechanical locking with a coding housing of a complementary plug connector.

22. The HF angle plug connector of claim 6, including an extension element arranged on the locking element displaceable along the locking element.

23. The HF angle plug connector of claim 8, wherein the locking element is designed as a rocker.

24. The HF angle plug connector of claim 10, wherein the cover component and the exterior conductor component comprise identical materials.

* * * * *

UNITED STATES PATENT AND TRADEMARK OFFICE

CERTIFICATE OF CORRECTION

PATENT NO. : 8,251,762 B2
APPLICATION NO. : 13/126595
DATED : August 28, 2012
INVENTOR(S) : Maier et al.

It is certified that error appears in the above-identified patent and that said Letters Patent is hereby corrected as shown below:

In the claims:

In Column 7, Line 9 (Claim 5) delete "MEGA" and
substitute therefore -- OMEGA --

In Column 8, Line 12 (Claim 17) delete "MEGA" and
substitute therefore -- OMEGA --

Signed and Sealed this
Twenty-fourth Day of December, 2013

Margaret A. Focarino

Margaret A. Focarino
*Commissioner for Patents of the United States Patent and Trademark Office*